United States Patent [19]

Breslow et al.

[11] 4,339,135

[45] Jul. 13, 1982

[54] ELECTRONIC MATRIX BOARD GAME APPARATUS AND METHOD

[75] Inventors: Jeffrey D. Breslow, Highland Park; Alex Imatt; Christian H. Oberth, both of Chicago, all of Ill.

[73] Assignee: Marvin Glass & Associates, Chicago, Ill.

[21] Appl. No.: 199,468

[22] Filed: Oct. 22, 1980

[51] Int. Cl.[3] ..... A63F 9/06

[52] U.S. Cl. ..... 273/237; 273/1 GC

[58] Field of Search ..... 273/1 GC, 1 GE, 1 E, 273/237, DIG. 28; 340/147 R, 166 R, 825.79, 825.82

[56] References Cited

U.S. PATENT DOCUMENTS

| | | | |
|---|---|---|---|
| 3,503,608 | 3/1970 | Ylinen | 273/1 GC |
| 3,781,802 | 12/1973 | Kafafian | 340/147 R |
| 4,017,072 | 4/1977 | Kurtz | 273/237 |
| 4,060,242 | 11/1977 | Huang et al. | 273/1 GC |
| 4,080,596 | 3/1978 | Keck et al. | 340/323 R |
| 4,171,135 | 10/1979 | Doyle et al. | 273/237 |
| 4,182,514 | 1/1980 | Magid et al. | 273/237 |
| 4,184,676 | 1/1980 | Barish | 273/237 |
| 4,235,442 | 11/1980 | Nelson | 273/237 |
| 4,285,517 | 8/1981 | Morrison | 273/1 GC |

OTHER PUBLICATIONS

*Basic Computer Games*, Mar. 1975.

*Primary Examiner*—Vance Y. Hum
*Assistant Examiner*—Leo P. Picard
*Attorney, Agent, or Firm*—Mason, Kolehmainen, Rathburn & Wyss

[57] ABSTRACT

An electronic computer game and method includes a matrix of 25 LED's (light emitting diodes) and two sets of push button switches positioned on opposite sides of the matrix. Each set of push buttons comprises a group of five push buttons corresponding to the five rows of the matrix and a group of five push buttons corresponding to the five columns of the matrix. Each set of push buttons is arranged so that the ten fingers of a player may be placed on the push buttons and any one of the LED's in the matrix may be rapidly selected by either player by simultaneous actuation of one push button in each of his groups. A game selector switch may be moved to select one of a number of games of action, reaction or strategy each of which is controlled by a microprocessor which stores selection of LED's by each player, sets up random patterns on the matrix which are randomly altered, keeps track of each player's score and provides audible and visual signals informing the players of the progress of the game, etc.

50 Claims, 12 Drawing Figures

Fig 3
LANDRUSH
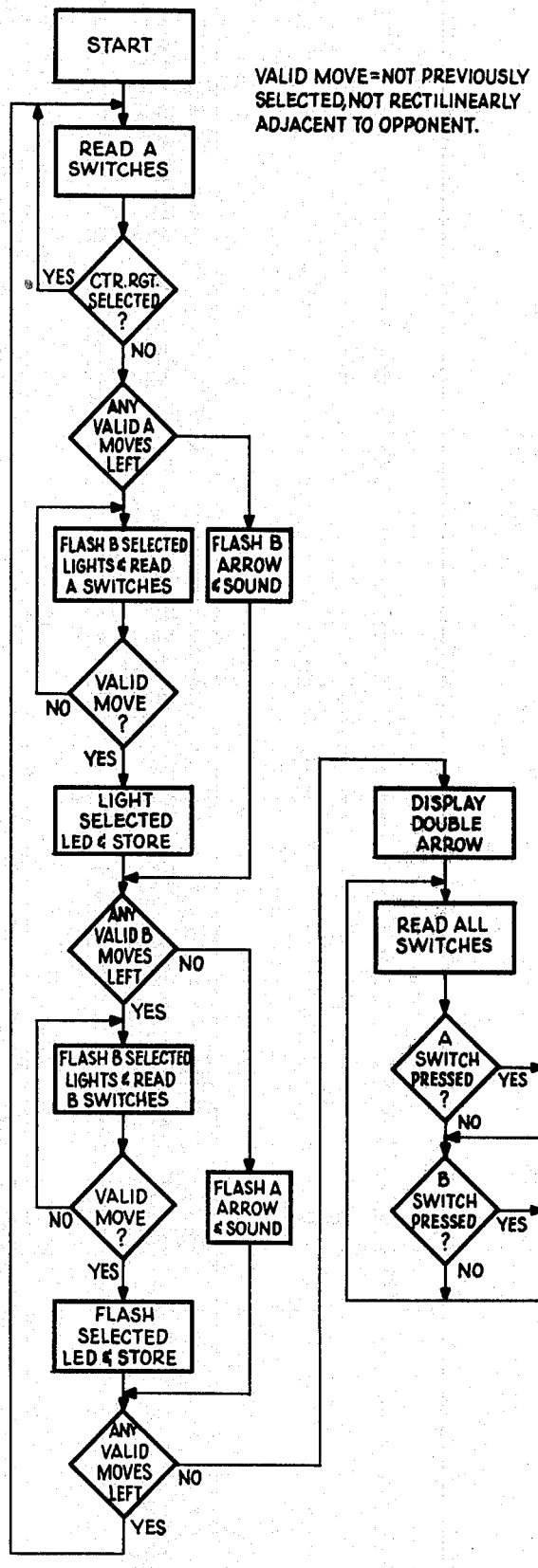
VALID MOVE=NOT PREVIOUSLY SELECTED, NOT RECTILINEARLY ADJACENT TO OPPONENT.
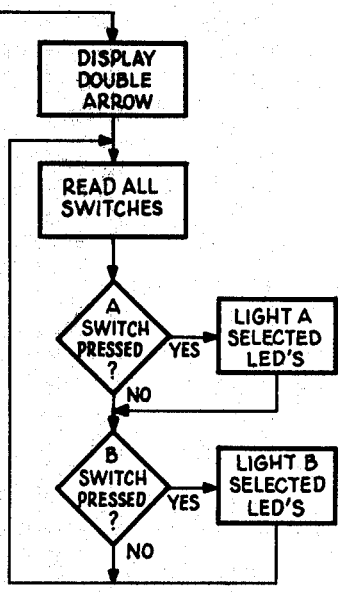
Fig 4
THREE IN A ROW (VISIBLE)
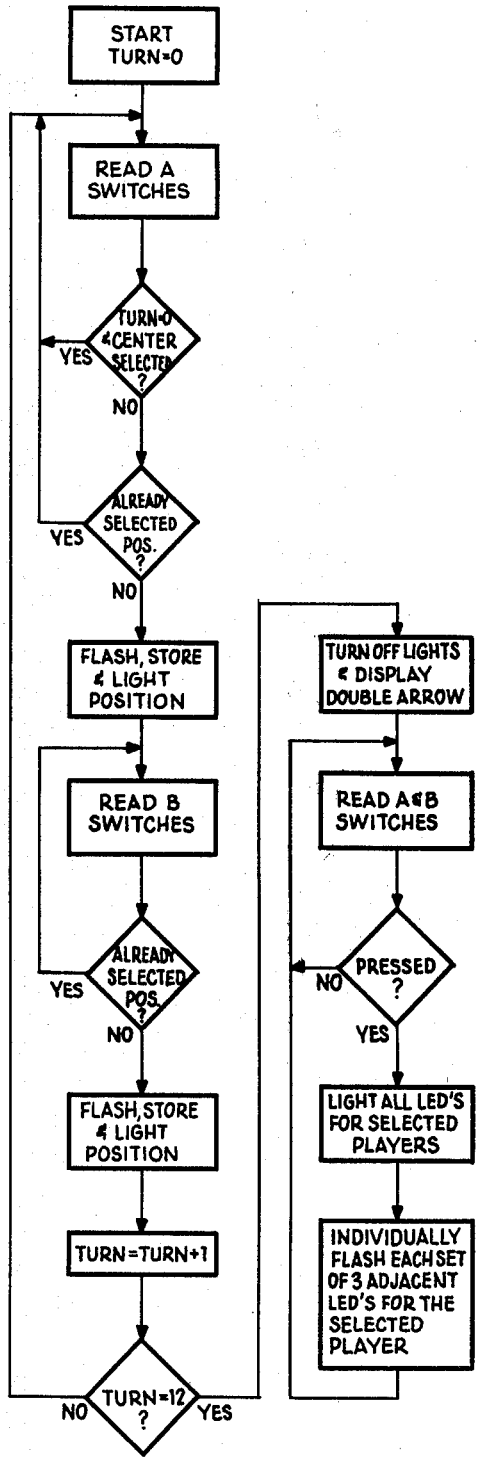

THREE IN A ROW (INVISIBLE)

PATTERNS

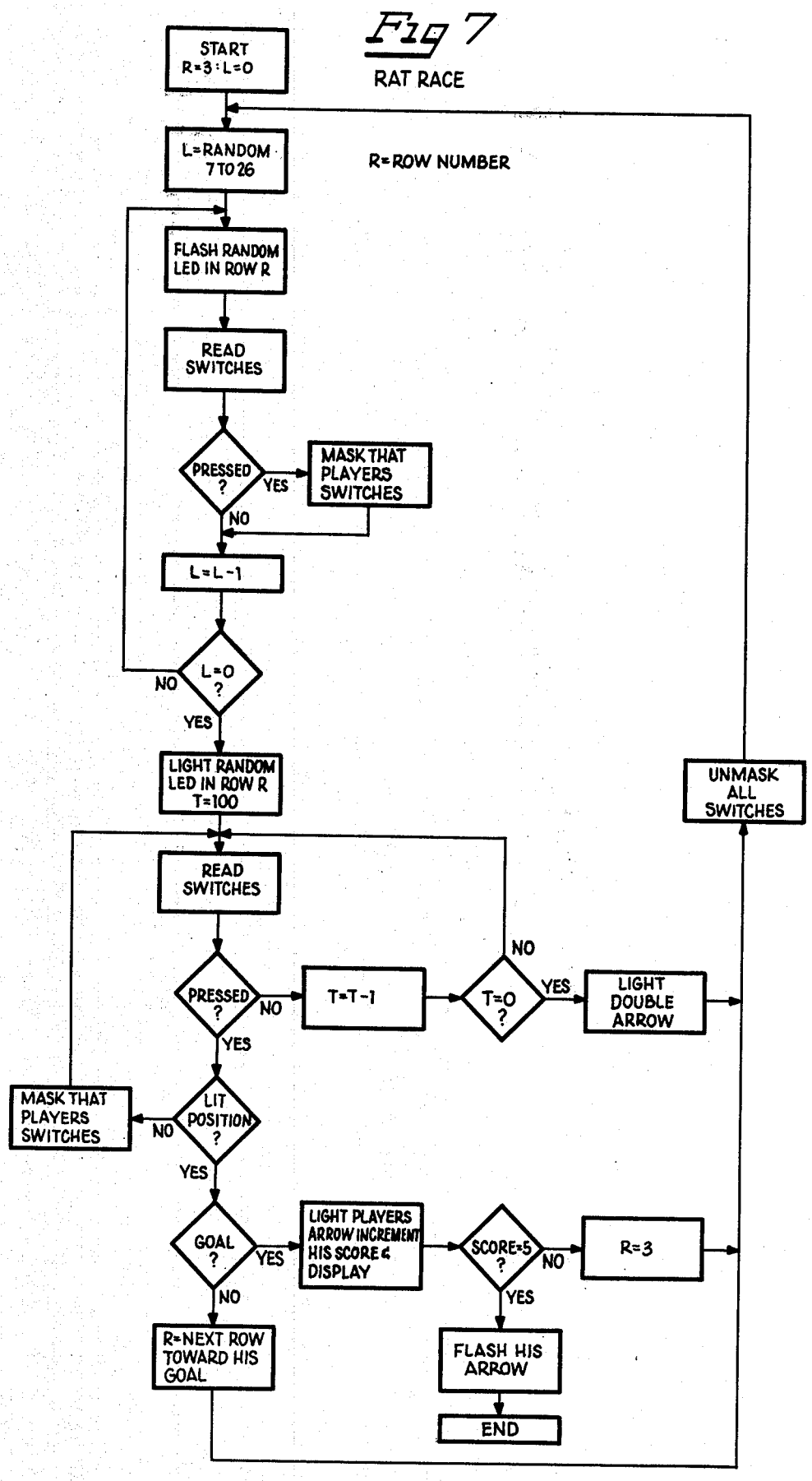
Fig 7
RAT RACE
START R=3 : L=0
L=RANDOM 7 TO 26
R=ROW NUMBER
FLASH RANDOM LED IN ROW R
READ SWITCHES
PRESSED ?
YES
MASK THAT PLAYERS SWITCHES
NO
L=L-1
L=0 ?
NO
YES
LIGHT RANDOM LED IN ROW R T=100
UNMASK ALL SWITCHES
READ SWITCHES
PRESSED ?
NO
T=T-1
T=0 ?
NO
YES
LIGHT DOUBLE ARROW
YES
MASK THAT PLAYERS SWITCHES
NO
LIT POSITION ?
YES
GOAL ?
YES
LIGHT PLAYERS ARROW INCREMENT HIS SCORE & DISPLAY
SCORE=5 ?
NO
R=3
YES
NO
R=NEXT ROW TOWARD HIS GOAL
FLASH HIS ARROW
END

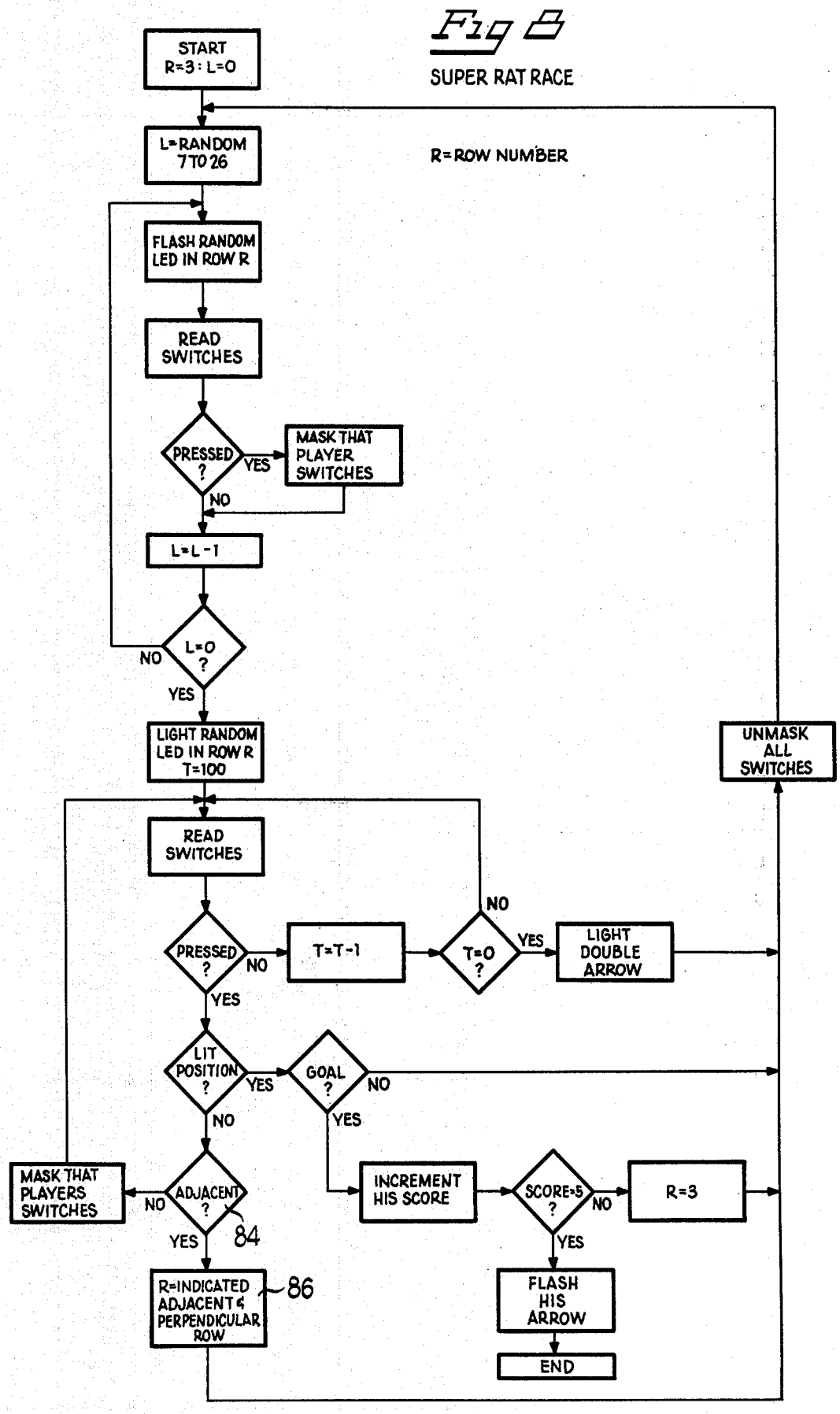
Fig 8
SUPER RAT RACE
R=ROW NUMBER
START R=3 : L=0
L=RANDOM 7 TO 26
FLASH RANDOM LED IN ROW R
READ SWITCHES
PRESSED ?
YES
MASK THAT PLAYER SWITCHES
NO
L=L-1
L=0 ?
NO
YES
LIGHT RANDOM LED IN ROW R T=100
READ SWITCHES
PRESSED ?
NO
T=T-1
T=0 ?
NO
YES
LIGHT DOUBLE ARROW
YES
LIT POSITION ?
YES
GOAL ?
NO
YES
NO
MASK THAT PLAYERS SWITCHES
NO
ADJACENT ?
84
YES
R=INDICATED ADJACENT & PERPENDICULAR ROW
86
INCREMENT HIS SCORE
SCORE>5 ?
NO
R=3
YES
FLASH HIS ARROW
END
UNMASK ALL SWITCHES

ELECTRONIC MATRIX BOARD GAME APPARATUS AND METHOD

FIELD OF THE INVENTION

The present invention relates generally to games, and more particularly to electronic board games which employ a matrix of light emitting devices which may be selectively energized by a player in accordance with the rules of a particular game.

DESCRIPTION OF THE PRIOR ART

Various types of electronic board games have been heretofore proposed. Certain of these games have involved a matrix of light emitting devices one or more of which may be energized in predetermined ways. Examples of such matrix type board game are found in Super U.S. Pat. No. 3,092,390, McGinn U.S. Pat. No. 3,152,805, Kurtz U.S. Pat. No. 4,017,072 and Magid et al U.S. Pat. No. 4,182,514. Other electronic games have employed a microprocessor to control energization of a series of light emitting devices to provide a visual display and one or more players may attempt to match the display by manual control of switches or the like. Examples of such microprocessor controlled games are shown in Huang et al U.S. Pat. No. 4,060,242 and Conner U.S. Pat. No. 4,095,785.

SUMMARY OF THE INVENTION

Briefly, in accordance with the game apparatus and method of the present invention a matrix of twenty-five light-emitting diodes (LED's) is provided and two sets of push buttons are positioned on opposite sides of the matrix. Each set of push buttons comprises a group of five push buttons corresponding to the five rows of the matrix and a group of five push buttons corresponding to the five columns of the matrix. Each set of push buttons is arranged so that the ten fingers of a player may be placed on the push buttons and any one of the LED's in the matrix may be rapidly selected by either player by simultaneous actuation of one push button in each of his groups corresponding to the row and column in which said one LED is located. A microprocessor is employed to store and indicate selection of LED's by each player, establish certain selections as invalid moves and provide visual and audible signals informing the players when an invalid move is attempted. The microprocessor may also identify which LED's have been selected by one player by lighting them continuously and identify the LED's selected by the other player by flashing them intermittently. The microprocessor may also identify and store all combinations of LED's selected by either player which comprise three adjacent LED's in a horizontal, vertical or diagonal line in the matrix and may respond to a player's selective actuation of one of his push buttons after the game is over by sequentially flashing each set of three LED's selected by that player so that the player may determine his score.

In accordance with a further aspect of the invention, the microprocessor may flash a randomly selected group or pattern of LED's in the matrix for a random number of times and then add or subtract one LED, each player having a predetermined short interval to identify the altered LED by actuation of his push buttons corresponding to the row and column of the altered LED.

In accordance with another aspect of the present invention the microprocessor is programmed to flash the LED's in a predetermined row of the matrix and then light one of the LED's in that row continuously for a brief interval. The microprocessor responds to identification of said one LED by a player within said brief interval by thereafter moving to a row or column nearer a predetermined one of the LED's assigned as that player's goal and then repeating the procedure during successive rounds of the game.

BRIEF DESCRIPTION OF THE DRAWINGS

The invention, both as to its organization and method of operation, together with further objects and advantages thereof, will best be understood by reference to the following detailed description, taken in conjunction with the accompanying drawings, in which:

FIG. 3 is a flow chart of the program provided in the microprocessor portion of the board game of FIG. 1 which is employed to play the game identified as "Land Rush";

FIG. 4 is a flow chart of a program for the microprocessor portion of the board game of FIG. 1 which is employed in playing the game identified as "Three in a Row (Visible)";

FIG. 7 is a flow chart of a program for the microprocessor portion of the board game of FIG. 1 which is employed to play the game identified as "Rat Race";

FIG. 8 is a flow chart of a program for the microprocessor portion of the board game of FIG. 1 which is used in playing the game identified as "Super Rat Race"

Figure 1:
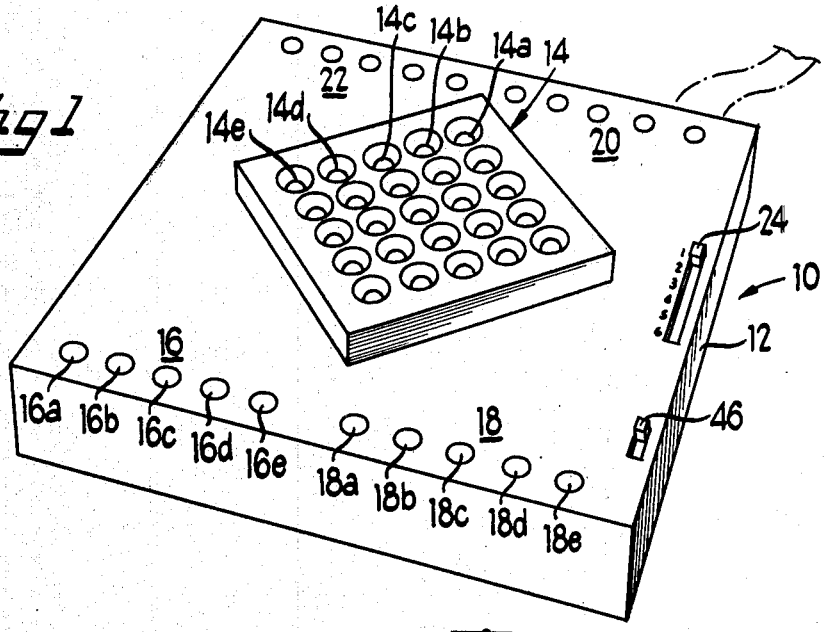
FIG. 1 is a perspective view of the electronic board game of the present invention.

Referring now to the drawings, the microprocessor controlled electronic board game of the present invention is therein illustrated generally at 10. The game 10 is enclosed in a housing 12 that contains a matrix 14 of light emitting diodes arranged in rows and colunns, two sets of push buttons 16, 18 and 20, 22 which are positioned on opposite sides of the matrix 14, and a game selector switch 24 which may be moved to one of six different positions to select different games which may be played, as will be described in more detail hereinafter.

Preferably the rows 14*a*, 14*b*, etc. of light emitting diode in the matrix 14 are oriented at a 45 degree angle with respect to the sides of the housing 12 along which the push buttons 16, 18, and 20, 22 are positioned, as indicated in FIG. 1. Such an arrangement is advantageous when certain patterns are displayed during the game to communicate with the players, as will be described in more detail hereinafter.

In accordance with an important aspect of the present invention, the matrix 14 comprises twenty-five light emitting diodes, or other light emitting devices, which are arranged in five rows and five columns, the resulting ten rows and columns corresponding to the ten push buttons provided on either side of the display 14. Thus, the push buttons 16 comprise a first button 16*a* which corresponds to row 14*a* of the matrix 14, the push button 16*b* corresponds to the second row 14*b* thereof, the push button 16*c* corresponds to the third row 14*c* of LED's in the matrix 14, etc. Similarly, the first push button 18*a* corresponds to the first or left-hand column of LED's in the matrix 14, the push button 18*b* corresponds to the second column of LED's, the push button 18*c* corresponds to the middle column of LED's, etc. In a similar manner the push buttons 20, 22 correspond respectively to the five rows of the matrix 14, and the five push buttons 22 correspond to the five columns of this matrix. With such an arrangement, player A may place his ten fingers on the set of push buttons in front of him and by simultaneous actuation of a button in the set 16 and a button in the set 18 cause the LED which is positioned at the intersection of the corresponding row and column in the matrix 14 to be energized. In a similar manner, player B by simultaneously pressing a push button in the set 20 and a push button in the set 22 can energize the particular one of the LED's in a matrix 14 which is located in the insection of the row and column corresponding to the selected push buttons. By employing a series of five rows and five columns in the matrix 14 an arrangement is provided in accordance with the present invention whereby any one of the LED's in the matrix 14 may be rapidly selected by simultaneous actuation of two of the push buttons, one by each hand of the player. However, considerable skill in involved in identifying a particular LED which is to be identified and translating the position of that LED into its corresponding X and Y coordinates, as will become apparent from the description of various games which can be played on the game board of FIG. 1 described hereinafter.

Figure 2:
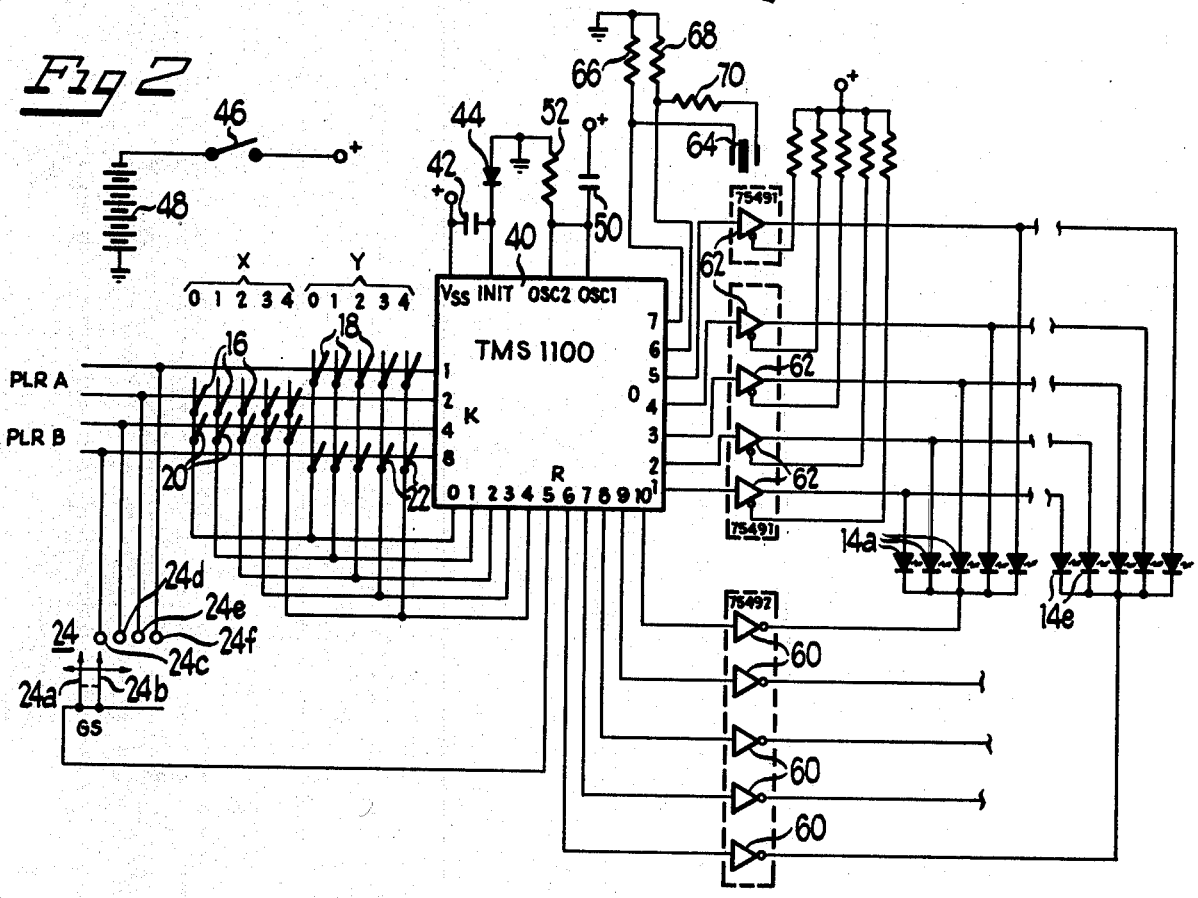
FIG. 2 is a schematic diagram of the electronic circuit employed in the game of FIG. 1.

Referring now to FIG. 2, the electronic circuitry of the present illustration is therein illustrated as comprising a microprocessor 40 which is preferably a Type TMS 1100 single-chip microprocessor manufactured by Texas Instruments, Inc. which contains suitable input and output circuitry so as to sample the push button switches 16, 18, 20 and 22 and energize the appropriate ones of the light emitting diodes 14*a*–14*e* of the matrix 14.

A time delay circuit comprising the capacitor 42 and diode 44 are utilized to reset and initialize the operation of the microprocessor 40 each time the power is turned on by closing the on off switch 46 which supplies power from the 9-volt battery 48 also positioned within the housing 12. A timing circuit comprising a capacitor 50 and resistor 52 controls the operation of the internal clock or oscillator of the microprocessor 40 which typically operates at approximately 300 KHz. The time delay circuit and the timing circuit described above are selected in accordance with the design data published in the TMS 1100 series data manual by Texas Instruments, Inc. Furthermore, the microprocessor 40 is readily programmed in a manner described in the aforesaid data manual to perform the functions necessary to play the games described in a later portion of this specification.

The push button switches 16 and 18 which are employed by one player, designated as player A, are connected respectively to the K2 and K1 input lines of the microprocessor, respectively. In a similar manner the push button switches 20 and 22 assigned to player B are connected respectively to the K4 and K8 input lines of the microprocessor. The individual switches of the sets 16, 18, 20 and 22 are connected to the R0, R1, R2, R3 and R4 outputs of the microprocessor 40. Accordingly, by sequentially energizing the outputs R0–R4 while monitoring the inputs K1–K8, closure of any one of these switches may be identified by the microprocessor 40. For example, if the R0 output line is energized and the switch 16*a* is closed an input will be provided on the K2 input line of the microprocessor 40. Such energization of the input K2 when the output R0 is energized is recognized by the input circuitry of the microprocessor 40 as an actuation of the push button 16*a*.

The game switch 24 is a slide switch having the two interconnected movable contacts 24*a* and 24*b* which are connected to the output line R5 of the microprocessor 40. The switch 24 comprises four stationary contacts 24*c*, 24*d*, 24*e* and 24*f* which are connected respectively to the K8, K4, K2 and K1 input lines of the microprocessor 40. The slide switch 24 has six detented positions in the first position of which neither of the contacts 24*a* and 24*b* is in contact with any of the four contacts of the switch 24 so that an input game selection code of "0" is provided to the microprocessor. In the next position of the switch 24 the contact 24*b* engages the fixed contact 24*c* so that an input code of "8" is provided over the K8 input line when the output line R5 is energized. In the next position of the switch 24 both of the contacts 24*a* and 24*b* make contact with the contacts 24*c* and 24*b*, respectively, so that a game selection input code of "12" is supplied to the microprocessor 40. In the three succeeding positions of the switch 24 game selection codes of "6", "3" and "1" are provided. In the last position of the switch 24, only the contact 24*a* makes contact with the fixed contact 24*f*.

The output lines R6–R10 of the microprocessor are respectively connected through driver stages 60 to the cathodes of each row of light emitting diodes 14*a*–14*e* of the array 14, only the top and bottom rows 14*a* and 14*e* of the array 14 being shown in FIG. 2. Preferably the drivers 60 are of the commercial type 75492.

The 01–05 outputs of the microprocessor 40 are employed selectively to drive the anodes of each set of five LED's in each horizontal row through the drivers 62. Preferably, the drivers 62 are of the commercial type 75491. Thus, when an output is sequentially applied to the output line R10, the output lines 01–05 selectively control energization of the five light emitting diodes in the top row 14*a* of the array 14.

The output lines 06 and 07 are employed to energize a suitable loud-speaker device 64 which is biased by means of the resistors 66, 68 and 70. Accordingly, various sounds required at different times during the playing of the games selected by the game selector switch 24 are developed within the microprocessor 40 and supplied to the loud-speaker device 64.

As discussed heretofore, the microprocessor 40 is programmed so that a number of different games may be played on the game device 10, the particular game being determined by the setting of the game selector switch 24. During each game the microprocessor continuously monitors the push buttons 16–20 in connection with various situations involving action reaction or strategy between the players.

The first game which may be played on the game device 10 is known as "Land Rush". In this game two players, who sit on opposite sides of the board 10 and control respectively the push button sets 16, 18 and 20, 22 take alternate turns to try to light as many lights on the matrix 14 as they can. However, once a light has been lit by one of the players the microprocessor 40 rejects as an invalid move any attempt by the other player to light an LED which is adjacent to the opponents lit light and in the same row or column as that lit light. In order to permit the players to determine which lights have been selected by each player, player A's lights are lit continuously whereas the light selected by player B are energized intermittently so that they produce a flashing light. While the microprocessor 40 will reject any illegal attempt to make an invalid move the player does not lose his turn by attempting to make such an illegal move. However, the first player is prevented from lighting the center light of the array 14 on his first turn. Such a rejection does not result in a loss of turn to the first player but means that he cannot select the strategically strong center position on his first turn.

Figure 10:
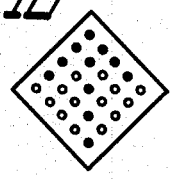
Figure 11:
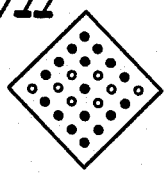

When one player has made his last valid move, as determined by the microprocessor 40, the microprocessor 40 supplies an audio tone signal to the loud-speaker 64 to inform the other player that he may make all of his remaining possible valid moves, one after the other. In addition, the microprocessor 40 is programmed so that it produces a visual indication which informs both players that the first player has made his last valid move and that the other player should proceed to make all of his possible valid moves. More particularly, assuming that player A is seated before the switches 16, 18 and player B is seated before the switches 20, 22 and that player A has made his last possible valid move, the microprocessor 40 is arranged simultaneously to light selected ones of the LED's in the array 14 so as to provide an arrow which point toward player B, as shown in FIG. 10 of the drawings.Player B then proceeds to make all of his possible valid moves. When player B has made his last valid move, the microprocessor 40 signals that the game has come to an end by simultaneously energizing predetermined ones of the LED's in the array 14 so that a double arrow is produced, as shown in FIG. 11. The players are then informed by the production of this double arrow that the game is over. At the same time that the double arrow is produced the remainder of the lights in the array 14 are turned off by the microprocessor 40.

In order to determine the score of each player after the game is over, either player may depress any one of his push buttons and the microprocessor 40 is programmed to light all of the lights which he has captured during the game, these lights being stored in the microprocessor as the game proceeds. This player then proceeds to count the number of lights which he has captured after which the other player may depress any one of his push buttons and all of the lights which he has captured will light. The second player then counts high captured lights and the player with the highest score wins.

Figure 9:
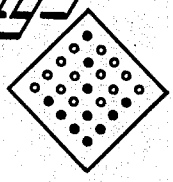
FIGS. 9, 10, 11 and 12 show various patterns which are produced on the matrix display of the game of FIG. 1 to communicate various messages to the players.

The flow chart of the routine provided in the microprocessor 40 to play the "Land Rush" game is shown in FIG. 3. It will be noted in referring to this flow chart that in addition to producing an audible tone signal when either player has made all of his possible valid moves, this fact is signified by flashing an arrow pointing to the other player. Thus, when player A has made all valid moves permitted to him, an arrow pointing to player B, as shown in FIG. 10, is flashed at the same time that the sound signal is produced so as to inform the players visually that player A has exhausted all possible moves. If, on the other hand, player B is the one to make all his possible valid moves first, an arrow pointing to player A, as shown in FIG. 9, is flashed coincidently with the production of the audible tone signal. The players are thus informed that player A should proceed to make all of his valid moves after which there are no valid moves left to either player, and the double arrow shown in FIG. 11 is produced indicating the end of the game.

The second game which may be played with the game device 10 is called "Three in a Row (Visible)". In this game the players make alternate moves and have a predetermined number of moves, such as 12 before the game is over. During his turn each player lights one of the lights in the array 14 by simultaneous actuation of a selected row and column switch, the object of the game being to acquire as many combinations of "Three in a Row" lit lights as possible. The "Three in a Row" combinations may be either in the horizontal, vertical or diagonal direction. As in the previously discussed game "Land Rush", the first player, player A, may not light the center light of the array 14, although he does not lose a turn by attempting to do so. When a light is lit by one of the players, it flashes for several cycles and is thereafter illuminated steadily. Such an arrangement thus requires that each player must remember which lights are his, since after the brief flashing interval when he selected his light, his light will be steadily lit just as are his opponents. He must also remember which lit lights are his opponents in order to plan his strategy of making "Three in a Row" or blocking his opponent from doing the same.

When each player has had his twelve turns, the array 14 goes blank except for the production of the double arrow shown in FIG. 11 which indicates that the game is over. In order to score the game one player presses any one of his row or column switches and the microprocessor 40 responds by lighting all of the lights which he has selected. The microprocessor then proceeds successively to flash on all "Three in a Row" combinations which that player has acquired, these combinations being flashed one set at a time so that the player may count them. The other player then presses any one of his row or column push buttons and his score is similarly displayed. The player making the highest score wins.

Figure 5:
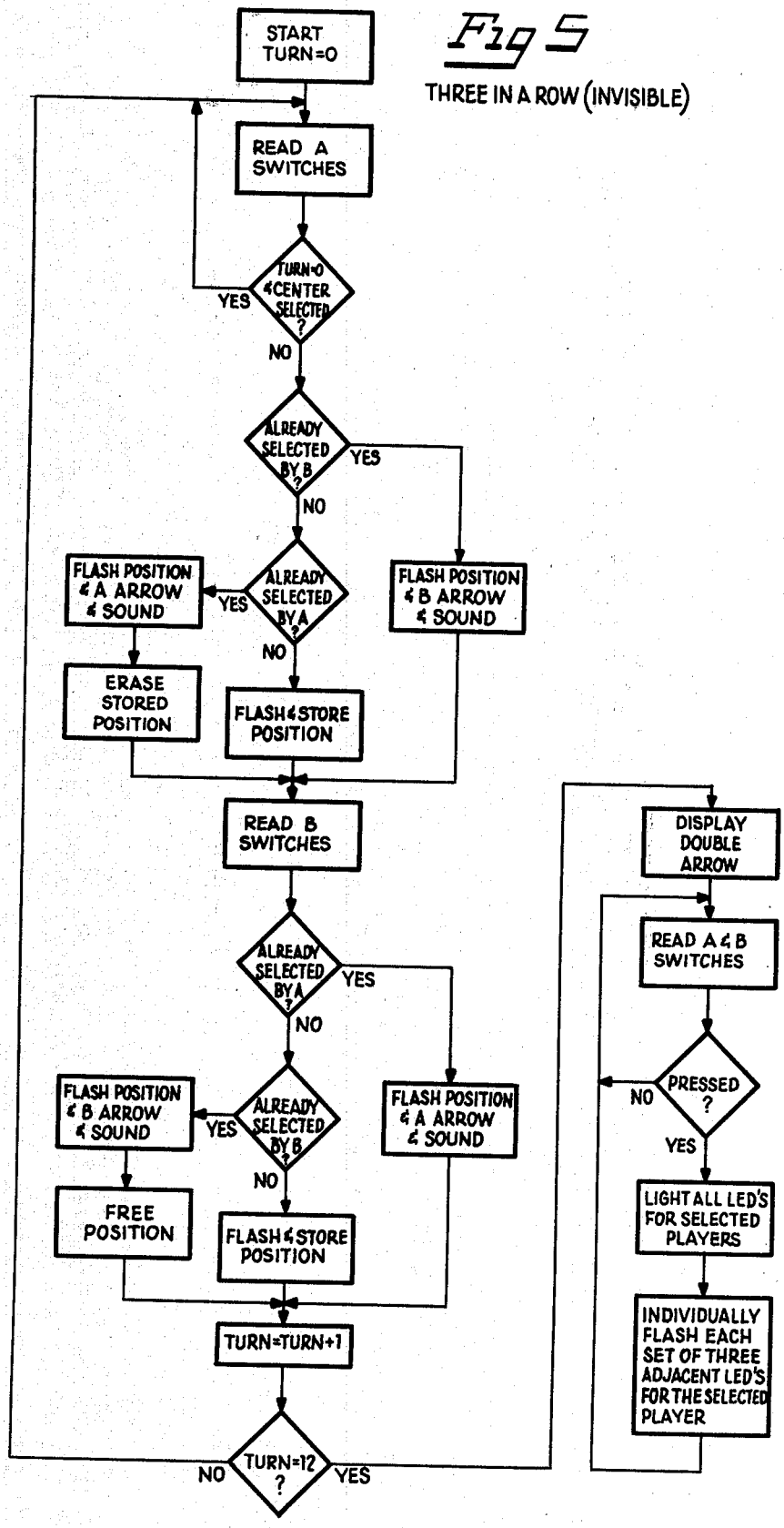
FIG. 5 is a flow chart of a program for the microprocessor portion of the board game of FIG. 1 which is used in playing the game identified as "Three in a Row (Invisible)"

A third game which is called "Three in a Row" (Invisible)" may also be played by the game device 10. This third game is similar to Three in a Row (Vibible) except for the fact that after a player has selected a light it flashes for several cycles and then is extinguished. Accordingly, each player must remember which lights are his and which are his opponents without having any of the lights illuminated. Furthermore, since all lights are now extinguished, either player may select a light previously acquired either by his opponent or by himself, whereas in "Three in a Row (Visible)" such an event would not be likely, since all lights are continuously lit after they have been selected. In "Three in a Row (Invisible)" a penalty is therefore exacted if a previously acquired light is selected. More particularly, as shown in the flow chart in FIG. 5, if player A selects a light which has already been selected by player B he loses his turn and the players are informed of this fact by the production of an audible tone signal and the flashing of an arrow pointing to player B, as shown in FIG. 10. On the other hand, if player A selects a position which he himself had previously selected, he loses his turn and the position which he had previously selected is erased from memory by the microprocessor 40 so that this matrix position is thereafter free to be selected by either player. At the same time, an audible tone signal is produced and a flashing arrow pointing to player A, as shown in FIG. 9, is produced which informs both players that player A has not only lost his turn but has had to give up one of his previously selected positions. The same situation obtains in connection with the selection of a position by player B, as shown in the flow chart in FIG. 5.

After each player has had twelve turns, the double arrow shown in FIG. 11 is produced to inform the players that the game is over and the game is scored in a manner identical to that described above in connection with "Three in a Row (Visible)".

Figure 12:
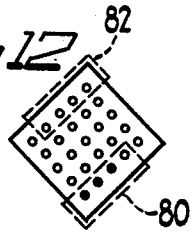

The fourth game which may be selected by the switch 24 is called "Patterns". The object of the game is to recognize a change in a repeated pattern of lights on the array 14 which is produced by the microprocessor 40, the first player to identify the light which has been changed by pressing his row and column switches which define that light winning one point in the game. The first player to reach a predetermined number of points, such as five, wins the game. The pattern of lights created by the microprocessor may involve a random number of lights of from four to nine of the LED's in the array 14. Furthermore, this randomly created pattern is produced a random number of times, from three to six, before an additional light is randomly added or subtracted to the previously produced pattern. A timing period is started when an additional light is added to or subtracted from the pattern which lasts for only a few seconds. Either player must therefore recognize the addition to or subtraction from the previous pattern display and press his corresponding row and column push buttons very quickly in order to win a point. If neither player identifies the changed light in the pattern before the end of the time period, the double arrow shown in FIG. 11 is produced by the microprocessor and a new randomly created and randomly produced pattern is flashed on the array 14. If either player successfully identifies the light which is changed during the time period allotted, an arrow pointing to him is lit by the microprocessor, as shown in FIGS. 9 and 10 and the point which he has scored is stored in the microprocessor 40 so as to keep track of which player reaches a score of five first. In addition, the player's score is visually produced by the microprocessor after the player's arrow has been lit. To this end, predetermined ones of the lights in the array 14 are designated as scoring lights. For example, the lights within the dotted block 80 shown in FIG. 12 may be assigned to player A and the lights within the block 82 assigned to the player B. If player A has won three points, the first three lights in the block 80 would be lit, as shown in FIG. 12. When one of the players has reached a score of five, the arrow pointing to him is flashed thereby indicating the end of the game.

Since the pattern of lights produced by the microprocessor 40 for the pattern scheme is repeated a random number of times before a light is added to or subtracted from the pattern, there is a likelihood that one of the players may prematurely push one of his row or column switches. If he does so, his switches are masked for the ensuing time period after the light is added to or subtracted from the pattern so that he cannot win the next turn, but his opponent is permitted to try to do so. In addition, if either of the players presses his rod and column switches which do not correctly identify the light position which has been added to or subtracted from the pre-existing pattern, his switches are masked for the remainder of that period during which the other player may correctly identify the new position and win a point.

Figure 6:
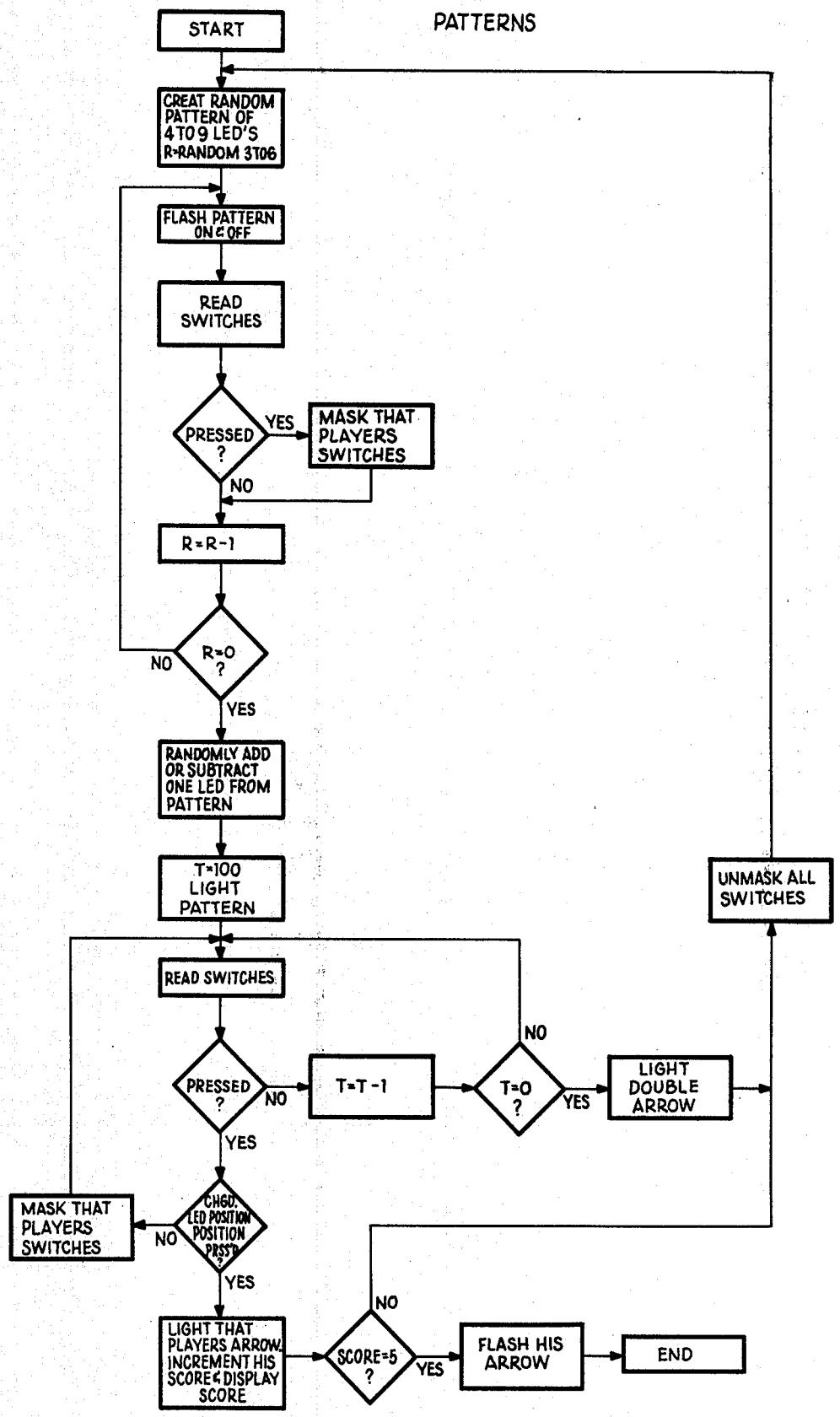
FIG. 6 is a flow chart of a program for the microprocessor portion of the board game of FIG. 1 which is employed in playing the game identified as "Patterns"

The flow chart for the routine provided in the microprocessor 40 to play the "patterns" game is shown in FIG. 6. It will be noted from this flow chart that the pattern of light produced by the microprocessor 40 randomly involves from four to nine of the LED's in the array 14, such a random pattern being produced in any suitable manner, as will be readily understood by those skilled in the art. It will also be noted that each selected pattern is flashed on and off a random number of times, from three to six being illustrated in the flow chart of FIG. 6, before a light is randomly added to or subtracted from the pattern.

The fifth game which may be selected by the switch 24 is called "Rat Race". In this game the center light in the row farthest from each player is identified as his "goal" light. At the start of the game, the microprocessor 40 randomly flashes lights in the center row of LED's **14*c* in the array 14. After a random number of lights have been flashed on in the center row, a light in the center row is continuously illuminated and a predetermined time period is initiated during which the players race to identify that light by correctly depressing the row and columns push buttons corresponding to the continously illuminated LED. If one of the players correctly identifies this light during the predetermined time period, the row of lights which is randomly flashed by the microprocessor 40 is advanced toward his goal light. Thus, for example, if player A correctly identifies the light which is lit in the row 14*c* within a predetermined time period, the microprocessor then randomly flashes the lights in the row 14*b*. On the other hand, if player B first identifies the continuously lit light in the center row, the microprocessor thereafter flashes the lights in row 14*d*. If neither player correctly identifies the light in the center row during the predetermined time period, the microprocessor illuminates a double arrow pattern, as shown in FIG. 11**. The microprocessor then continues to flash lights randomly in the center row until one of the players correctly identifies the light that remains lit in the center row for the predetermined time period.

If either player presses one of his push buttons prematurely i.e. before the continuously light is lit in that row he is penalized by masking his switches for that row round so that he cannot thereafter identify the continuously lit position during that time period. Also, if either player presses a combination of push buttons which do not identify the lit position that player's switches are masked so that he cannot correctly identify that position during that row round.

When the light reaches the goal row of one player, that player must continue to identify the lit position first in order to maintain the play in his goal row until the continuously lit position coincides with his goal light and he first identifies this goal position at which time he scores a point. Since the light which remains lit in each of the rows is randomly determined, it will be seen that the attacking player may have to identify the randomly selected continuously lit position in the goal row a number of times before his goal light becomes the lit position and he first identifies it. The play may thus move back and forth across the rows of the array 14 a number of times before either player is successful in making a goal.

When either player makes a goal, his arrow is displayed, his score which is stored in the microprocessor 40 is incremented and his incremented score is displayed on the array 14, in a manner similar to that described heretofore in connection with the game "Patterns". Also, when either player has scored five points his arrow is flashed indicating the end of the game, as described heretofore in connection with the game "Patterns."

The flow chart corresponding to the routine provided in the microprocessor 40 to play the "Rat Race" game is shown in FIG. 7. In connection with this figure it will be noted that each time a player scores a point, the microprocessor is programmed to return to the middle row of lights to begin a new game point. At this time all players' switches are unmasked so that each may participate equally in the new game point. Similarly, if either player's switches have been masked during a predetermined row round without successful identification of the lit position, all switches are unmasked before that row is randomly flashed during the next row around.

The sixth game which may be selected by the switch 24 is called "Super Rat Race". This game is similar to the game "Rat Race" described in detail heretofore. However, in the "Super Rat Race" game the corner lights of the array 14 farthest from each player is assigned as his goal light. Furthermore, the microprocessor 40 is programmed so that it will change from flashing lights in one of the rows 14*a*–14*e* of the array 14 to flashing lights in one of the columns of the array if a player, instead of identifying the lit position in a particular row, identifies a light position which is adjacent to the lit position and is in the same row or column as the lit position. More particularly, assuming that the microprocessor 40 is flashing the lights in the center row 14*c* of the array 14, and that the center light of this row remains lit for the predetermined identification time period, if either player identifies a light adjacent to the center light, in the center row during the predetermined time period, the microprocessor 40 will respond by flashing the lights in the vertical column which includes that adjacent light during the next row round. On the other hand, if one of the players identifies the position adjacent the center light and immediately above or below it, the microprocessor 40 will flash the lights in the row which includes that adjacent position during the next row round. It will thus be seen that in each case the microprocessor responds to the identification of an adjacent position by flashing lights in the row or column which includes this adjacent position and is prependicular to a line connecting the lit position and the adjacent position. If either player identifies the lit position, rather than an adjacent position in the same row or column, the microprocessor continues to flash lights in the same row or column during the next row round. Accordingly, in order to advance the action into his goal row or column, either player must identify a position adjacent to the lit position rather than the lit position itself.

Since the goal positions for each player are now the corner lights of the array 14, both the row and column terminating in this goal light become scoring rows for that player. Furthermore, by identifying the appropriate adjacent position rather than the lit position a player may more quickly reach his scoring row than in the game "Rat Race" described heretofore. Thus, for example, if the microprocessor 40 is flashing lights in the center row 14*c* at the start of the game and stops on the light 14*g*, i.e. the light to the left of the center light of the array 14, for the predetermined time period, player A may be identifying the adjacent position to the left of the lit position 14*g* in the center row and cause the microprocessor to thereafter flash lights in the first column of the array 14 which includes his scoring goal at the upper corner of the array 14. Player A then attempts to identify the lit position in this column during succeeding row rounds until the lit position coincides with his goal light. If he also identifies the lit position when it coincides with his goal light he then wins a point. However, if the opponent first identifies the lit position when it coincides with player A's goal light, the microprocessor advances one row or column towards the opponent's goal light. In this case, when it is assumed that the column which includes player's A goal light was being flashed, the microprocessor would move over one column toward player B's goal light and flash the lights in this column during the next row round.

If the lit position corresponds with player A's goal position, player B has two choices, first if he identifies player A's goal position first during the predetermined time period, rather than player A identifying this position and scoring a point, the microprocessor will continue to randomly flash lights in the same row or column which includes player A's goal during the next row round. Since player B knows ahead of time the position of player A's goal light, he may very quickly identify this position and choose to do so rather than permitting player A to make a goal and scoring a point. On the other hand, player B may identify a position adjacent to player A's goal and if he does identify this adjacent position before A identifies his own goal position, and during the predetermined time period, the play will move to the row or column which includes his selected adjacent position thereby moving the play away from player A's goal row or column.

The score of either player may be indicated in the same manner as described in detail heretofore in connection with the game "Patterns". After a predetermined number of points has been scored by a player, such as five, this player wins the game and his arrow is flashed to indicate this fact.

In FIG. 8 the flow chart corresponding to the routine provided in the microprocessor 40 to play the game "Super Rat Race" is shown. As discussed heretofore this flow chart is substantially identical to the flow chart of FIG. 7 except for the shift of play from rows to columns in response to the identification of an adjacent position is shown by the decision blocks 84 and 86 in FIG. 8. In this connection it should be noted that both rows and columns are termed "rows" in the language employed in the flow chart of FIG. 8, the "adjacent and perpendicular row" of block 86 referring to a row (row or column) which is perpendicular to a line connecting the lit position and the adjacent position.

While there have been illustrated and described various embodiments of the present invention, it will be apparent that various changes and modifications thereof will occur to those skilled in the art. It is intended in the appended claims to cover all such changes and modifications as fall within the true spirit and scope of the present invention.

What is claimed as new and desired to be secured by Letters Patent of the United States is:

1. A game device comprising means defining an array of indicator devices arranged in rows and columns, first and second groups of switches positioned on opposite sides of said array for use by first and second players, each of said groups including a switch corresponding to each of said rows and a switch corresponding to each of said columns, and means responsive to the simultaneous actuation of one of said row switches in one of said groups and one of said column switches in the same group for energizing that one of said indicator devices which is located in the row and column corresponding to said simultaneously actuated row and column switches, further including means for determining the indicator device previously energized, and means for preventing energization of those indicator devices which are located immediately adjacent an indicator device previously energized by one player in response to the simultaneous actuation of the corresponding row and column switches by the other player.

2. The game device of claim 1, which includes means for preventing the first player from energizing the indicator device at the center of said array on his first turn.

3. The game device of claim 1, wherein said indicator devices which are prevented from being energized are located in the same row or the same column as said oreviously energized indicator device.

4. The game device of claim 1, which includes means for developing a signal when all possible indicator devices in said array have been energized by both of said players.

5. The game device of claim 4, which includes means responsive to said signal for simultaneously energizing groups of said indicator devices which are positioned in the array so that each energized group of indicator devices simulates an arrow pointing to one of the players.

6. The game device of claim 5, which includes means operative after said arrow simulating groups of indicator devices have been energized and responsive to actuation of any one of the row and column switches assigned to one player for simultaneously energizing all of the indicator devices previously energized by that player during the game, thereby to permit said one player to determine his score by counting the number of said simultaneously energized indicator devices.

7. The game device of claim 1, wherein said indicator devices are light emitting devices, means for controlling the indicator devices selected by one of said players so that they emit a steady light, and means for controlling the indicator devices selected by the other player so that they emit a flashing light.

8. The game device of claim 1, which includes means responsive to energization by one player of all indicator devices in said array which are permitted by said energization preventing means for developing an audible tone signal.

9. The game device of claim 8, which includes means operative after said audible tone signal is developed and responsive to energization by the other player of all indicator devices in said array which are permitted by said energization preventing means for simultaneously energizing groups of said indicator devices which are positioned in the array so that each energized group of indicator devices simulates an arrow pointing to one of the players.

10. A game device comprising an array of light emitting devices arranged in rows and columns, first and second groups of switches positioned on opposite sides of said array for use by first and second players, each of said groups including a switch corresponding to each of said rows and a switch corresponding to each of said columns, and means responsive to the simultaneous actuation of one of said row switches in one of said groups and one of said column switches in the same group for causing the light emitting device located in the row and column corresponding to said simultaneously actuated row and column switches to intermittently light for a brief interval, said game device further including means for indicating when the adjacent ones of said light emitting devices along a line have all been energized and further including means responsive to the simultaneous actuation of a row and column switch in either of said groups for causing the light emitting device located in the row and column corresponding to said simultaneously actuated row and column switches to flash intermittently for a brief interval and then emit light continuously.

11. The game device of claim 10, which includes means for preventing the first player from energizing the light emitting device at the center of said array on his first turn.

12. The game device of claim 10, which includes means responsive to a predetermined number of simultaneous actuations by each player for developing a signal indicating the end of the game.

13. The game device of claim 12, wherein said signal comprises the illumination of only selected ones of said light emitting devices which are positioned in said array so as to form arrows pointed toward both of the players.

14. The game device of claim 10, which includes means for indicating when three adjacent ones of said light emitting devices along a horizontal, vertical or diagonal line have all been energized.

15. The game device of claim 13, which includes means operative in response to actuation of any row or column switch by a player after said signal is developed for successively indicating each group of three adjacent ones of said light emitting devices along a horizontal, vertical or diagonal line which have been selected by that player during the game.

16. The game device of claim 15, wherein said groups of three adjacent light emitting devices are indicated by simultaneously causing them to emit light intermittently.

17. The game device of claim 12, which includes means operative in response to actuation of any row or column switch by a player after said signal is developed for first energizing all of said light emitting devices which have been selected by that player during the game and then successively causing each group of three adjacent ones of said light emitting devices along a horizontal, vertical or diagonal line which have been selected by that player during the game to flash intermittently.

18. The game device of claim 10, which includes means responsive to the simultaneous actuation of a row and column switch in either of said groups for causing the light emitting device located in the row and column corresponding to said simultaneously actuated row and column switches to flash intermittently for a brief interval and then cease emitting light.

19. The game device of claim 18, which includes means for storing representations corresponding to the light emitting devices selected by each of the players, and means responsive to the selection of a light emitting device by one player which has already been selected by the other player for causing said previously selected light emitting device to emit flashing light.

20. The game device of claim 19, which includes means for simultaneously energizing a group of said light emitting devices which collectively form an arrow pointed to said other player, thereby to indicate that said one player has lost his turn.

21. The game device of claim 18, which includes means for storing representations corresponding to the light emitting devices selected by each player, and means responsive to the selection of a light emitting device by one player which has already been selected by said one player for causing said previously selected device to emit light intermittently.

22. The game device of claim 21, which includes means for removing the representation corresponding to said previously selected device from said storage means, so that said previously selected device may thereafter be selected by either player.

23. The game device of claim 22, which includes means for simultaneously energizing a group of said light emitting devices which collectively form an arrow pointing to said one player.

24. A game device comprising an array of light emitting devices arranged in rows and columns, a group of switches including a switch corresponding to each of said rows and a switch corresponding to each of said columns, means for repeatedly energizing a pattern group of said light emitting devices, wherein said group includes a plurality of simultaneously energised light emitting devices, means operative after repeated energization of said group of devices for altering the pattern by adding thereto or deleting therefrom one device, means responsive to the simultaneous actuation of the row and column switches corresponding to the row and column of the light emitting device which was added to or deleted from the pattern for producing an indication.

25. The game device of claim 24, wherein said indicating means is operative only in the event said simultaneous actuation is made within a predetermined time interval after said pattern is altered.

26. The game device of claim 24, which includes two of said groups of row and column switches one for each of two players, and means responsive to the first simultaneous actuation of the row and column switches in one of said groups corresponding to the row and column in which said one device is located for indicating said one group.

27. The game device of claim 26, wherein said two groups of switches are on opposite sides of said array and said indicating means comprises means for simultaneously energizing a group of said light emitting devices which collectively simulate an arrow pointing to said one group of switches.

28. The game device of claim 26, wherein said indicating means comprises means for energizing a predetermined one of said devices in the vicinity of said one group of switches.

29. The game device of claim 26, which includes means for repeatedly energizing different patterns of said devices and then altering the pattern by adding thereto or deleting therefrom one device, and means for storing and indicating the number of times said one device is selected by each player.

30. The game device of claim 24, wherein said indicating means comprises means for simultaneously energizing a number of said devices within a predetermined scoring group in said array corresponding to the number of times said one device has been selected by one of said players.

31. The game device of claim 26, which includes means for developing a different indication in the event said one device is not selected by either of said players within a predetermined time period.

32. The game device of claim 31, wherein said two groups of switches are on opposite sides of said array and said different indication comprises means for simultaneously energizing two groups of said light emitting devices, each group of simultaneously energized devices collectively simulating an arrow pointing toward one of said players.

33. A game device comprising an array of light emitting devices arranged in rows and columns, first and second groups of switches one for each of two players, each group including a switch corresponding to each of said rows and a switch corresponding to each of said columns, means for determining a predetermined time period, means for randomly energizing different light emitting devices in a predetermined row of said array, means for thereafter continuously energizing one of the devices in said predetermined row, and means for identifying said one device by simultaneously actuating the row and column switches in one of said groups corresponding to the row and column in which said one device is located wherein one of said devices in each of the top and bottom rows of said array is designated as the goal device for each of said players, and means operative in response to identification of said one device within a predetermined time period after the random energization of said one device for randomly energizing different light emitting devices in the next row of said array toward the goal row of the player who first identifies said one device.

34. The game device of claim 1, which includes means responsive to identification of his goal device by one player for producing an indication.

35. The game device of claim 34, wherein said indication comprises the illumination of a group of said devices located in said array so that they collectively simulate an arrow pointing to said one player.

36. The game device of claim 33, which includes means for storing and indicating the number of times each player identifies his goal device.

37. The game device of claim 36, wherein said scoring indication comprises means for simultaneously energizing a number of said devices within a predetermined scoring group in said array corresponding to the number of times the goal device has been identified by one of said players.

38. The game device of claim 36, which includes means responsive to a predetermined number of identifications of his goal device by one player for producing a game winning indication.

39. The game device of claim 38, wherein said game winning indication comprises means for intermittently energizing a group of said devices located in said array so that they collectively simulate an arrow pointing to said one player.

40. The game device of claim 33, which includes means operative in the event said one device is not identified by either player within a predetermined time period after it is energized for producing an indication.

41. The game device of claim 40, wherein said indication comprises means for simultaneously energizing a group of said devices located in said array so that they simulate arrows pointed at both of said players.

42. The game device of claim 33, which includes means responsive to actuation of any one of said switches by a player prior to continuous energization of said one device for disabling that player's group of switches.

43. The game device of claim 33, which includes means responsive to the actuation of a row and column switch by either player which does not identify said one device for disabling that player's group of switches.

44. The game device of claim 33, wherein a predetermined one of said devices is designated as a goal device for each of said players, and means operative in response to actuation of the row and column switches corresponding to a device adjacent to said one device in said predetermined row within a predetermined time period for randomly energizing different light emitting devices in the column which contains said adjacent device.

45. The game device of claim 33, which includes means operative in response to actuation of the row and column switches corresponding to a device adjacent to said one device and in the same row or column as said one device for randomly energizing different light emitting devices in the row or column which contains said adjacent device and is perpendicular to a line connecting said one device and said adjacent device.

46. A microprocessor controlled portable game comprising:

a generally rectangular, portable housing;

a microprocessor within said portable housing;

an array of light emitting devices arranged in rows and columns on said housing and visible from atop thereof;

first and second series of push buttons one for each of two players connected to said microprocessor and positioned on opposite sides of said array, each series including a push button for each of said rows and a push button for each of said columns;

means including said microprocessor and responsive to simultaneous actuation of a row push button and a column push button in one of said series for energizing the light emitting device in the row and column corresponding to said simultaneously actuated push buttons; and means within said microprocessor for identifying a simultaneous actuation of a row and column push button in either of said series corresponding to a previously selected light emitting device by one player or a device adjacent to a device previously selected by the other player and in the same row or column as said device previously selected by said other player as an invalid move and means responsive to said identifying means for preventing the energization of said adjacent device.

47. The microprocessor controlled game of claim 46, which includes means within said microprocessor for determining when no further valid moves are available to either player and energizing an end of game indicator.

48. The microprocessor controlled game of claim 46, which includes means within said microprocessor for determining when no further valid moves are available to one player and energizing an indicator signifying that the other player may complete any valid moves available to him.

49. The method of playing a microprocessor controlled game of the type which includes an array of light emitting devices arranged in rows and columns and two sets of manually operable switches, one for each of two players, for identifying different ones of said devices, which comprises the steps of establishing a predetermined time period, sequentially energizing different ones of said devices in a predetermined one of said rows at random, then maintaining one of the devices in said predetermined row illuminated continuously for the predetermined time period, identifying said one device by one of the players and responding to the identification of said one device by one of the players within said time period by sequentially energizing different ones of said devices at random in the row adjacent to said predetermined row which is closer to a predetermined one of said devices designated as a goal for said one player.

50. The method of playing a microprocessor controlled game of the type which includes an array of light emitting devices arranged in rows and columns and two sets of manually operable switches, one for each of two players, for identifying different ones of said devices, which comprises the steps of establishing a predetermined time period, sequentially energizing different ones of said devices in a predetermined one of said rows at random, then maintaining one of the devices in said predetermined row illuminated continuously for the predetermined time period, identifying said one device by one of the players, and responding to the identification of a device adjacent to said one device and in the same row or column as said one device by one of the players within said time period by sequentially energizing different ones of said devices at random in the row or column which contains said adjacent device and is perpendicular to a line connecting said one device and said adjacent device.

* * * * *